US010522126B1

(12) United States Patent
Nordstrand

(10) Patent No.: US 10,522,126 B1
(45) Date of Patent: Dec. 31, 2019

(54) HUM-CANCELLING SYSTEM

(71) Applicant: Carey J. Nordstrand, Redlands, CA (US)

(72) Inventor: Carey J. Nordstrand, Redlands, CA (US)

( * ) Notice: Subject to any disclaimer, the term of this patent is extended or adjusted under 35 U.S.C. 154(b) by 0 days.

(21) Appl. No.: 16/251,232

(22) Filed: Jan. 18, 2019

Related U.S. Application Data

(60) Provisional application No. 62/618,815, filed on Jan. 18, 2018.

(51) Int. Cl.
*G10H 3/14* (2006.01)
*G10H 3/18* (2006.01)

(52) U.S. Cl.
CPC ..... *G10H 3/181* (2013.01); *G10H 3/143* (2013.01); *G10H 2220/501* (2013.01); *G10H 2220/511* (2013.01); *G10H 2220/565* (2013.01)

(58) Field of Classification Search
CPC .. G10H 3/181; G10H 3/143; G10H 2220/511; G10H 2220/565; G10H 2220/501
USPC ..... 84/728
See application file for complete search history.

(56) References Cited

U.S. PATENT DOCUMENTS 4,442,749 A * 4/1984 DiMarzio ..... G10H 3/181 84/728
5,311,806 A * 5/1994 Riboloff ..... G10H 3/182 84/728
5,530,199 A * 6/1996 Blucher ..... G10H 3/181 84/728
5,569,872 A 10/1996 Gimpel
5,668,520 A * 9/1997 Kinman ..... G10H 3/181 336/84 R
5,834,999 A 11/1998 Kinman
6,103,966 A 8/2000 Kinman
6,121,537 A * 9/2000 Pawar ..... G10H 3/182 84/728
7,022,909 B2 4/2006 Kinman
7,227,076 B2 * 6/2007 Stich ..... G10H 3/181 84/726
7,259,318 B2 8/2007 Chiliachki
8,664,507 B1 3/2014 Lawing
10,217,450 B2 * 2/2019 Baker ..... G10H 3/182
2004/0003709 A1 1/2004 Kinman
2005/0150364 A1 * 7/2005 Krozack ..... G10H 3/182 84/726
2005/0162247 A1 7/2005 Beller
2019/0057678 A1 * 2/2019 Baker ..... G10H 3/181

FOREIGN PATENT DOCUMENTS

WO 2014/165943 A1 10/2014

* cited by examiner

*Primary Examiner* — Jeffrey Donels
(74) *Attorney, Agent, or Firm* — Thomas E. Lees, LLC

(57) ABSTRACT

A hum-cancelling system includes two or more hum-cancelling coils configured in a distributed manner, connected in series with each other. The hum-cancelling coils form a series circuit that is electrically connected to at least one pickup. Each hum-cancelling coil includes a top plate, a bottom plate, and a coil of wire wrapped between the top plate and the bottom plate.

17 Claims, 8 Drawing Sheets

200

POSITION

| | 1 | 2 | 3 | 4 | 5 |
|---|---|---|---|---|---|
| BRIDGE PICKUP | X | X | - | - | - |
| BRIDGE COIL | X | X | X | X | X |
| MIDDLE PICKUP | - | X | X | X | - |
| MIDDLE COIL | X | X | X | X | X |
| NECK PICKUP | - | - | - | X | X |
| NECK COIL | X | X | X | X | X |

FIG. 8

HUM-CANCELLING SYSTEM

CROSS REFERENCE TO RELATED APPLICATIONS

This application claims the benefit of U.S. Provisional Patent Application Ser. No. 62/618,815, filed Jan. 18, 2018, entitled "HUM-CANCELLING SYSTEM", the disclosure of which is hereby incorporated by reference.

BACKGROUND

The present disclosure relates in general to a hum-cancelling system for a stringed musical instrument, and more particularly to a hum-cancelling system for a stringed musical instrument that provides noise cancelling using distributed coils.

A typical electric, stringed musical instrument such as an electric guitar or electric bass includes body, a neck extending from the body, and a headstock situated at the end of the neck. A set of strings span between a bridge located on the body and a nut located on the neck adjacent to the headstock. When strummed, plucked, picked or otherwise stroked, the strings vibrate producing sound. However, the acoustical output of the vibrating strings may not be loud enough for an intended application. As such, the instrument typically includes one or more electromagnetic pickups. The pickups convert the vibration of the strings into a representative electrical signal that can be coupled to an amplifier to produce an appropriate level of sound from the instrument. However, such pickups are susceptible to noise and other interference, especially 60 Hz from conventional electrical power circuits.

BRIEF SUMMARY

According to aspects of the present disclosure, a hum-cancelling system comprises a first hum-cancelling coil having a top plate, a bottom plate, and a coil of wire wrapped between the top plate and the bottom plate. Analogously, a second hum-cancelling coil comprises a top plate, a bottom plate, and a coil of wire wrapped between the top plate and the bottom plate. The coil of wire of the first hum-cancelling coil is operationally configured to wire in series with the coil of wire of the second hum-cancelling coil. Also, when installed in a stringed musical instrument, the coil of wire of the first hum-cancelling coil is wound in the same direction as the coil of wire of the second hum-cancelling coil, and the first hum-cancelling coil is spaced from the second hum-cancelling coil. Additionally, the first hum-cancelling coil is positioned proximate to a first pickup, and the second hum-cancelling coil is positioned proximate to a second pickup.

According to further aspects of the present disclosure, a hum-cancelling system comprises a first hum-cancelling coil, which includes a top plate, a bottom plate, and a coil of wire wrapped between the top plate and the bottom plate. Likewise, a second hum-cancelling coil includes a top plate, a bottom plate, and a coil of wire wrapped between the top plate and the bottom plate. The hum-cancelling system also comprises a first pickup having a top flatwork, a bottom flatwork, and a coil assembly comprising a coil of wire wrapped around at least one magnetic pole. Likewise, a second pickup has a top flatwork, a bottom flatwork, and a coil assembly comprising a coil of wire wrapped around at least one magnetic pole. When installed in a stringed musical instrument, the coil of wire of the first hum-cancelling coil is operationally configured to wire in series with the coil of wire of the second hum-cancelling coil to define a hum-cancelling circuit. Also, the coil of wire of the first pickup is wound in the same direction as the coil of wire of the second pickup. However, a wind direction of the first pickup is opposite a wind direction of the first hum-cancelling coil and the second hum-cancelling coil. Moreover, the hum-cancelling circuit is switchably connected to at least one of the first pickup and the second pickup.

According to yet further aspects of the present disclosure, a stringed musical instrument, comprises an instrument body, a first pickup mounted to the instrument body, and a second pickup mounted to the instrument body. The stringed musical instrument also comprises a first hum-cancelling coil mounted to the instrument body and a second hum-cancelling coil mounted to the instrument body, where the second hum-cancelling coil is spaced apart from the first hum-cancelling coil so as to not touch or overlap. Yet further, the stringed musical instrument comprises a pickup selector switch that allows selecting at least one of the first pickup and the second pickup for output. Moreover, a circuit electrically wires the first hum-cancelling coil in series with the second hum-cancelling coil. The circuit is electrically coupled to at least one of the first pickup and the second pickup regardless of a position of the pickup selector switch.

BRIEF DESCRIPTION OF THE SEVERAL VIEWS OF THE DRAWINGS

FIG. 8 is a table illustrating the connections of the pickups and hum-cancelling coils for various pickup combinations;

DETAILED DESCRIPTION

Aspects of the present disclosure relate to a hum-cancelling system for electronic stringed musical instruments. The hum-cancelling system herein allows the use of single coil pickup configurations in a manner that reduces or eliminates the amount of 60 Hz hum and other noise and interference that is induced into a corresponding pickup (or pickups). Notably, the aspects of the present disclosure utilize distributed coils to perform noise reduction in a passive manner that does not require tuning, adjustment or other manual configuration.

Example Pickup Construction—Single Coil

Figure 1:
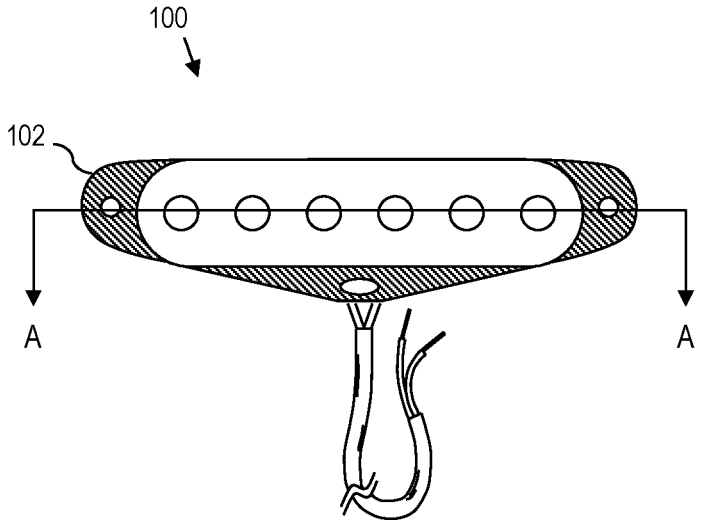
FIG. 1 is a top view of a pickup according to aspect of the present disclosure.

Referring now to the drawings and in particular to FIG. 1, a top view 100 illustrates a pickup 102 for an electrical, stringed musical instrument, according to certain aspects of the present disclosure. The pickup 102 is an electromagnetic device and has a cross-section along line A-A, which is provided to clarify the construction thereof, as described more fully herein.

Figure 2:
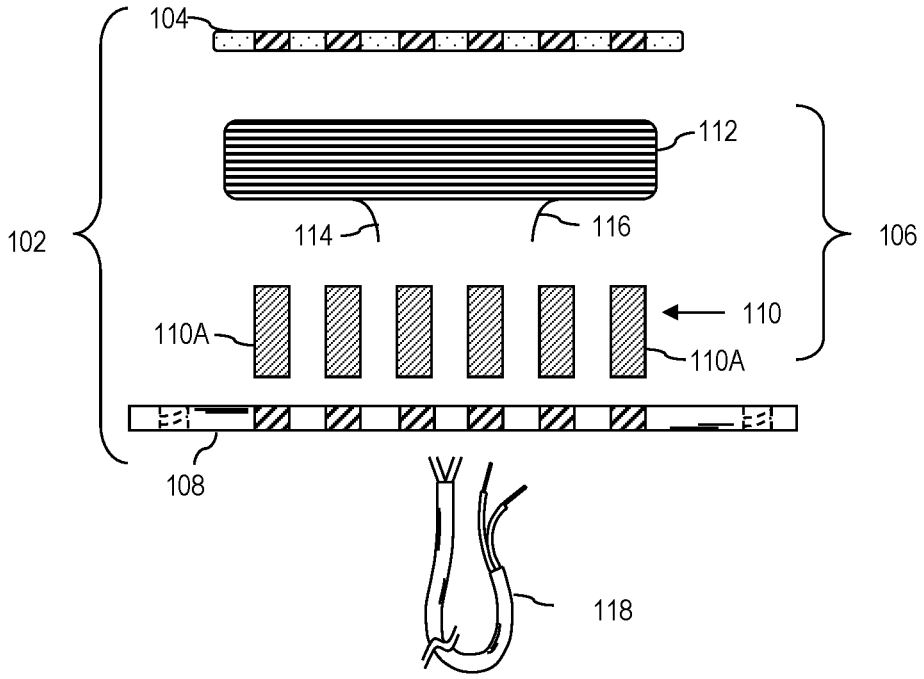
FIG. 2 is a cross-sectional exploded view of the pickup of FIG. 1.

Referring to FIG. 2, an exploded side view of the pickup 102 of FIG. 1 is illustrated along cross-section A-A of FIG. 1.

The illustrated embodiment of the pickup 102 includes in general, a primary (i.e., top) flatwork 104, a field sensing assembly 106, and a secondary (i.e., bottom) flatwork 108. In practice, the top flatwork 104 and the bottom flatwork 108 can be replaced with a single bobbin or other suitable frame structure.

Field Sensing Assembly

The field sensing assembly 106 includes a pole component 110 and a coil component 112.

The pole component 110 is comprised of one or more individual "poles" 110A. As used herein, the term "pole" 110A encompasses a single element, a combination of elements, an assembly of elements(s) and other structure(s), etc. As a few non-limiting but illustrative examples, the pole component 110 may be constructed from a ferrous material (e.g., iron or steel being the most common), a ferromagnetic material, a magnetic material, an otherwise magnetizable material, or any other suitable material that contributes to the ability of the pickup to create a magnetic field or otherwise sense a change in a magnetic field.

Moreover, the pole component 110 can be constructed in any suitable configuration. For instance, the pole assembly may be a blade, a set of individual slugs, a set of individual threaded pole pieces, any combination of blades, slugs and screws, one or more pole pieces with a separate magnet (or magnets), etc. As used herein, the term "slug" with regard to a pole 110A includes a generally cylindrical shape, a cube or cuboid shape, a spherical shape, an irregular shape or other desired configuration that can be magnetized or otherwise cooperate with a magnet structure to create a magnetic field about the pickup 100.

Solely for sake of clarity of discussion herein, the pole component 110 is illustrated as a set of slugs 110A. In this illustrative example, the pickup 100 is intended for an electric guitar, and thus has six slugs 110A, dimensioned and spaced within the top flatwork 104 and bottom flatwork 108 to generally align under each string of a corresponding instrument. In other example embodiments, the pole component 110 may be implemented as a set of slugs where one slug is dimensioned and spaced within the top flatwork 104 and bottom flatwork 108 to generally align under two or more strings of a corresponding instrument. The above-examples are non-limiting and other elements and configurations can be used as the pole component 110.

As used herein, the term "magnet" can in practice, be integral with the pole component 110. For instance, in the example of FIG. 2, each pole 110A is a magnetic pole or is otherwise magnetized. Alternatively, one or more separate magnets (not shown) can be provided, which are in magnetic cooperation with the pole component 110. As a few non-limiting but illustrative examples, the magnetic poles 110A (or separate magnet) can be ceramic, Alnico II, Alnico III, Alnico IV, Alnico V, or other magnet types.

The coil component 112 is comprised of a coil of wire having a first coil end 114 and a second coil end 116. The coil component 112 is wrapped around the pole component 110. Moreover, the first coil end 114 and the second coil end 116 form an electrical circuit with instrument electronics when installed in an electric stringed musical instrument as described more fully herein.

In an example embodiment of a guitar pickup, a typical wire would be heavy Formvar 42 AWG or plain enamel 42 AWG, but aspects herein are not limited to these wire types/gauges. Also, continuing the example of a guitar pickup, typical turn counts may be between 8000 and 9000 winds. Again however, aspects herein, are not limited to the example turn counts, as the number of turns will vary in order to achieve optimal or otherwise designed-for tonal qualities.

Moreover, the pickup 102 includes lead wires 118 for electrically connecting the coil component 112 to the electrical circuit of a corresponding stringed musical instrument (not shown). For instance, a first one of the lead wires 118 electrically connects to the first coil end 114 of the coil component 112, and a second one of the lead wires 118 electrically connects the second coil end 116 of the coil component 112.

In practice, the pickup 102 may be potted or otherwise processed as required by a particular desired effect.

Hum-Cancelling Coil

Figure 3:
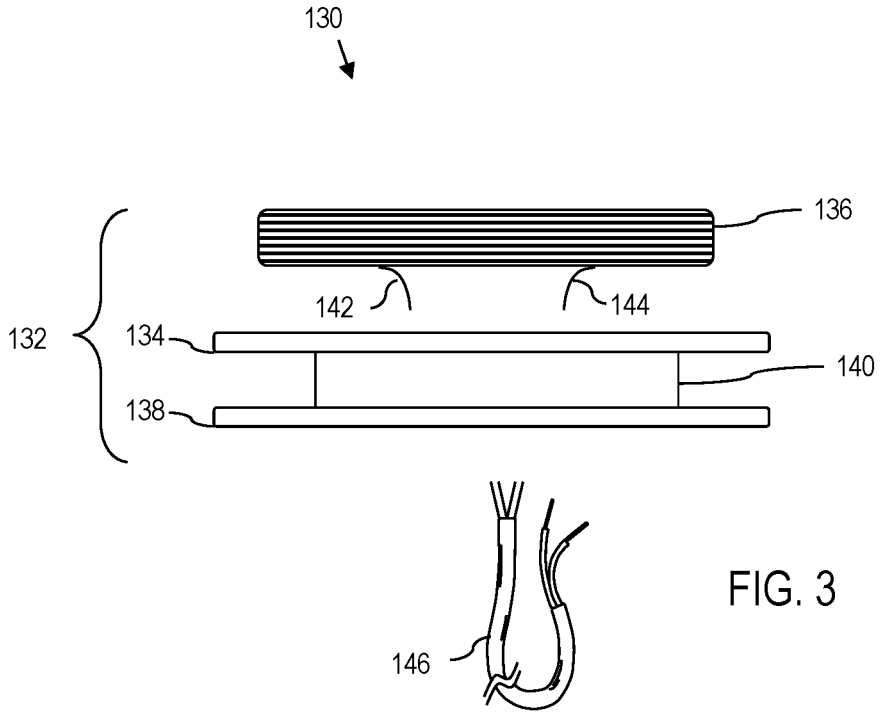
FIG. 3 is a side exploded view of a hum-cancelling coil that pairs with the pickup of FIG. 1, according to aspects of the present disclosure.

Referring to FIG. 3, a side view 130 (exploded for purposes of clarity) illustrates a hum-cancelling coil 132 according to aspects of the present disclosure. The hum-cancelling coil 132 includes in general, a coil of wire and a mounting structure. For instance, in the illustrated example, the hum-cancelling coil 132 comprises a top plate 134, a hum-cancelling coil assembly 136, and a bottom plate 138. In this regard, the top plate 134 and the bottom plate 138 form at least part of a mounting structure for the hum-cancelling coil assembly 136. For instance, in practical embodiments, the top plate 134 and the bottom plate 138 are separated by a spacer 140. In various embodiments, the top plate 134, the bottom plate 138 and the spacer 140 can be implemented by a bobbin, a unitary bobbin, frame, flatwork, or other construction. In some embodiments, the spacer 140 can be implemented as one or more non-magnetic slugs, a bar, or other suitable framework for wrapping the hum-cancelling coil assembly 136 between the top plate 134 and the bottom plate 138. In some embodiments, the mounting structure may not include a top plate and/or bottom plate, so long as a suitable coil and coil structure are maintained.

The hum-cancelling coil assembly 136 includes a coil of wire and has a first hum-cancelling coil end 142 and a second hum-cancelling coil end 144. In certain embodiments, the hum cancelling coil assembly 136 utilizes 41-gauge (or larger) wire with a typical turn count between 1000 and 4000 turns depending on optimal qualities of hum rejection and tonal quality, examples of which are discussed in greater detail herein. The use of relatively large gauge wire, e.g., 41-gauge wire, can be utilized, for example, where it is desirable to minimize the capacitive impact of the hum-cancelling circuit on the tonal quality of signal sensed by a corresponding pickup.

Moreover, in some embodiments, the mounting structure can include or otherwise be comprised of at least one inductance modifying feature. For instance, in an example embodiment, the mounting structure comprises a bobbin made from a ferrous material, metal, an alloy, etc. The use of such material for a bobbin also allows the physical material to be relatively thinner than plastic, fiber, vulcanized fiber, etc., typically used in pickups.

As a few non-limiting examples, the top plate 134, bottom plate 138, spacer 140, bobbin, frame, other hum-cancelling coil structure, combinations thereof, can comprise metal, an alloy, or other inductance affecting material to contribute to the overall inductance of the hum-cancelling coil 132. For instance, when using a spacer 140, the spacer 140 can comprise non-magnetic slugs, a bar, non-magnetic ferrous core, or other material that modifies the inductance of the hum-cancelling coil 132. As another example, the top plate 134 and bottom plate 138 can be made of a material such as steel, which contributes to the overall hum-cancelling coil inductance, and further allows the physical material to be relatively thinner than plastic, fiber, vulcanized fiber, etc., typically used in pickups. This allows the mounting structure to be constructed in a manner that minimizes the overall height required by the hum-cancelling coil 132 and increases overall coil impedance.

Increasing the total inductance of one or more hum-cancelling coils 132, correspondingly increases the total inductance of a series combination of the hum-cancelling coils 132. As a result, one or more hum-cancelling coils 132 can utilize a relatively smaller number of winds. This may result in a decrease of unfavorable tonal impacts typical of larger wind counts and can further contribute to a compact size. Further, using material to increase the overall inductance in one or more components of the mounting structure allows use of a larger wire for the hum-cancelling coils 132 to achieve the same effective cancellation of hum while lessening even further the undesirable impacts typical of hum cancelling systems.

Notably, typical pickup cavity routes can vary in size, but typically range from 0.625 inches (about 16 millimeters) to 0.75 inches (about 19 millimeters). Conventional pickups range in height from about 0.6 inches (about 15 millimeters) to about 0.8 inches (about 20 millimeters). Pickups typically stick out of the cavity by a slight amount. However, the result is that there is often little room to spare in the bottom of a pickup cavity of a corresponding instrument body. However, by distributing the total inductance/total impedance required for the hum-cancelling effect across multiple coils, aspects herein can provide a hum-cancelling circuit that uses conventional routes, requires no permanent modification, and enables the use stock pickups, or virtually any pickup of the user's choice. In an example of a typical three single coil pickup configuration, the impedance of the hum-cancelling circuit is split up into three, relatively small hum-cancelling coils 132. When installed in the pickup routes, this provides relatively more space for a normal pickup as each hum-cancelling coil only needs to account for ⅓ of the total impedance. Thus, each hum-cancelling coil takes up less space/has less impact on its neighboring pickup. This may allow enough room in a typical cavity to use any pickup of the user's choice. This also makes retrofitting possible with any single coil, multiple pickup installation.

The hum-cancelling coil 132 shares many similar attributes to the pickup 102 of FIG. 1 and FIG. 2, except that the hum-cancelling coil 122 does not include magnets, and/or magnetic pole components. In this regard, whereas a pickup 102 senses vibration of a corresponding instrument string, the hum-cancelling coils 132 do not sense vibration of the instrument string. Rather, the hum-cancelling coils cancel stray electromagnetic interference when combined with a pickup that also captures the same stray electromagnetic interference, e.g., 60 Hertz hum and harmonics thereof.

As illustrated, the hum-cancelling coil 132 includes lead wires 146 for electrically connecting the hum-cancelling coil assembly 136 to the electrical circuit of a corresponding stringed musical instrument (not shown) and as set out more fully herein. For instance, a first one of the lead wires 146 electrically connects to the first coil end 142 of the hum-cancelling coil assembly 136, and a second one of the lead wires 146 electrically connects the second coil end 144 of the hum-cancelling coil assembly 136. The lead wires 146, in turn, are used to form a series circuit of two or more hum-cancelling coils 132, and the overall series hum-cancelling coil circuit is wired to instrument electronics.

Figure 4:
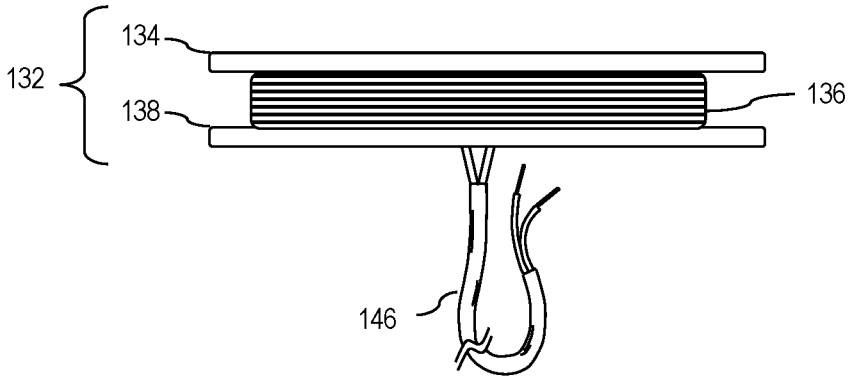
FIG. 4 is a side view of the hum-cancelling coil of FIG. 3 that pairs with the pickup of FIG. 1, according to aspects of the present disclosure.

Referring to FIG. 4, the hum-cancelling coil 132 is illustrated in an assembled state according to aspects of the present disclosure herein.

In an example configuration, the hum-cancelling coil 132 is configured to share a pickup cavity with a corresponding pickup 102 of FIG. 1 and FIG. 2, in a vertically stacked manner. As noted above, the hum-cancelling coil 132 includes a suitable mounting structure, e.g., a top plate 134, a hum-cancelling coil assembly 136, and a bottom plate 138. The mounting structure and corresponding coil assembly can be sized and dimensioned to fit inside a typical pickup cavity with a corresponding pickup.

Here, the total height of a pickup 102 stacked on top of a hum-cancelling coil 132 should be considered relative to the cavity dimensions and other instrument requirements.

Assembly into a Stringed Musical Instrument

Figure 5:
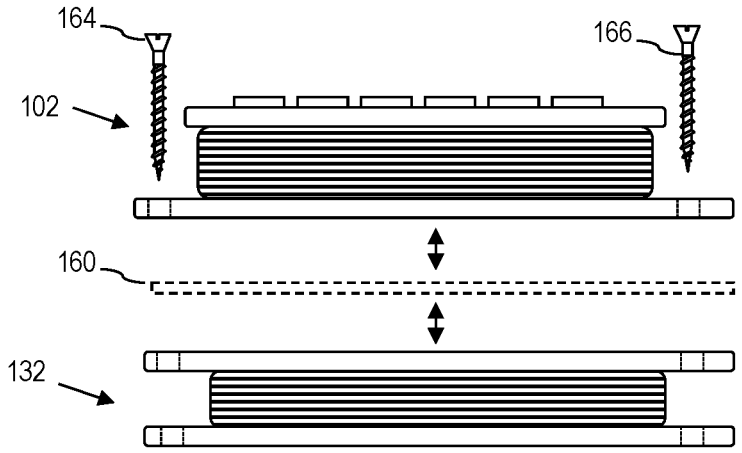
FIG. 5 is a side view illustrating a pickup stacked on top of a hum-cancelling coil according to aspects of the present disclosure.

Referring to FIG. 5, a pickup 102 can reside over a hum-cancelling coil 132 as illustrated. In some instances, the pickup 102 can sit on top of the hum-cancelling coil 132. In some embodiments, the pickup 102 can be fixedly mounted with the hum-cancelling coil 132, e.g., to reduce handling noise, etc. In other embodiments, it may be desirable to create some form of separation between the pickup 102 and corresponding hum-cancelling coil 132. For instance, as illustrated, an optional shield 160, e.g., a mu-metal, ferrous metal, etc., shield can be utilized to provide shielding between the pickup 102 and the hum-cancelling coil 132. Although illustrated as a flat plate, the shield 160 can take on any configuration (size, shape, position, etc.) to affect the magnetic fields to achieve a desired effect.

In example embodiments, the pickup 102 can be mounted to the hum-cancelling coil 132, e.g., using suitable fasteners. For sake of illustration, a first screw 164 and a second screw 166 are shown, which pass through corresponding apertures in the pickup 102 and hum-cancelling coil 132. In practice, the hum-cancelling coil 132 can be loosely coupled to the pickup 102 (e.g., merely resting under the pickup), magnetically attached, mechanically attached, bonded, or otherwise. In other embodiments, the pickup 102 is isolated from the hum-cancelling coil 132, e.g., using spacing, barrier, separation, independent fastening to the corresponding instrument body, etc. In further embodiments, the lead wires of the hum-cancelling coil 132 are not directly coupled to the lead wires of the pickup 102 to form a direct series or parallel connection. Rather, the lead wires of the pickup 102 wire to the instrument circuitry to function for conveying information of corresponding vibrating strings to an output. On the other hand, the lead wires of the hum-cancelling coil 132 form a series circuit with at least one other hum-cancelling coil 132, and that overall series circuit couples to instrument electronics for reducing or eliminating stray interference.

Figure 6:
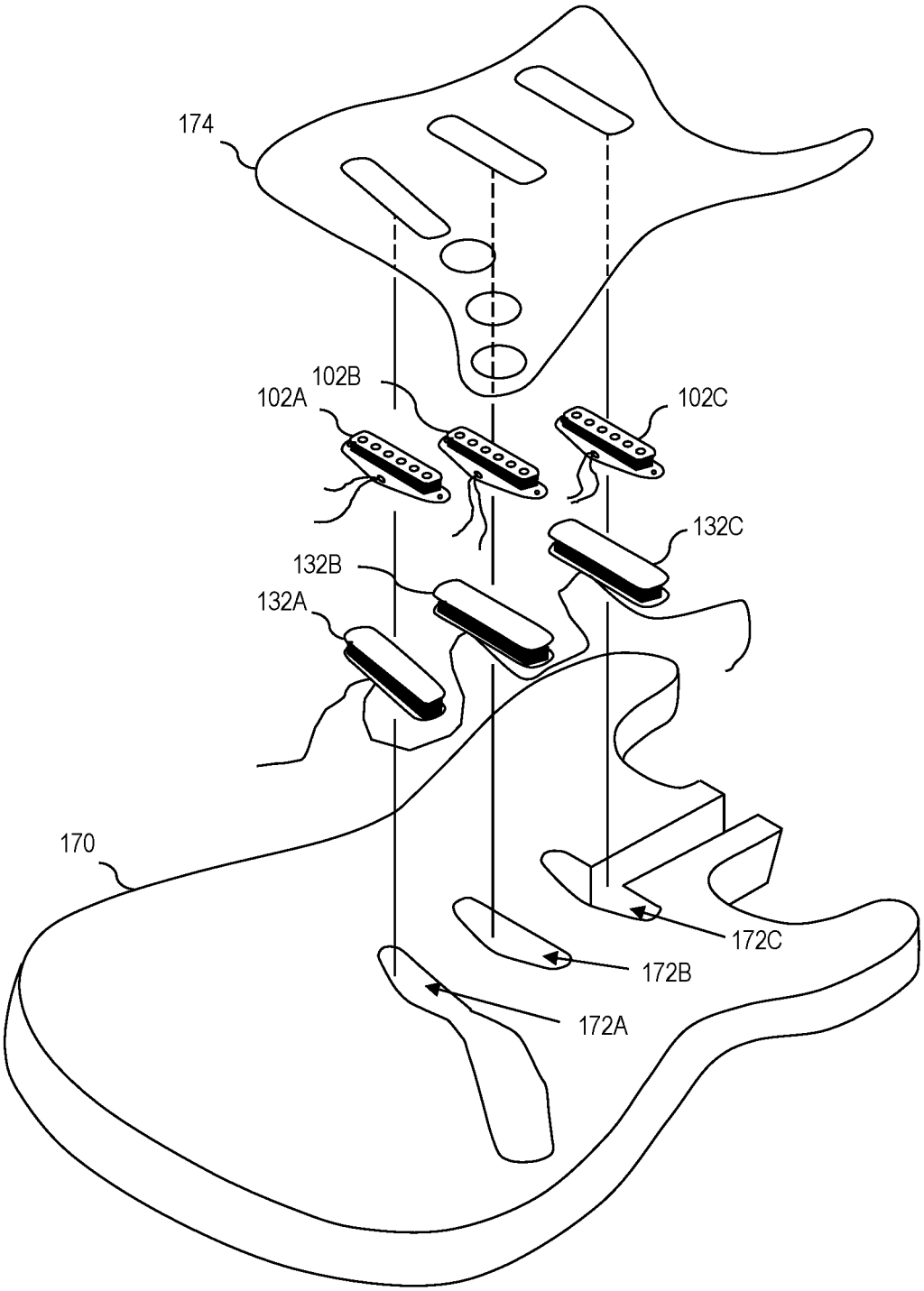
FIG. 6 is an exploded view illustrating three pickups and corresponding hum-cancelling coils being installed into an instrument body, according to aspects of the present disclosure.

Referring to FIG. 6, an example installation is illustrated in the context of a three-pickup stringed musical instrument. As illustrated, an instrument body 170 includes three pickup cavities, including a bridge pickup cavity 172A, into which a corresponding hum-cancelling coil 132A is installed, with a corresponding pickup 102A stacked vertically thereover. Likewise, a middle pickup cavity 172B in the instrument body 170 receives a hum cancelling coil 132B and corresponding pickup 102B stacked vertically thereover. Analogously, a neck pickup cavity 172C in the instrument body 170 receives a hum cancelling coil 132C and corresponding pickup 102C stacked vertically thereover. An optional pickguard 174 can be used to cover the pickup cavities. The instrument body 170 also includes one or more routes, passages, channels, drilled out passageways, provisions under the pickguard, etc., that allow the hum-cancelling coils 132 to be electrically wired together in series.

Referring to the FIGURES generally, as noted above, each hum-cancelling coil 132 can mount directly to the associated cavity 172 to mount to the instrument body 170 independent of a corresponding pickup 102. Alternatively, a pickup 102 and hum-cancelling coil 132 can be coupled, e.g., using fasteners such as bolts, screws, etc., to form an assembly that is then mounted into an associated cavity 172 of the instrument body 170.

Figure 7:
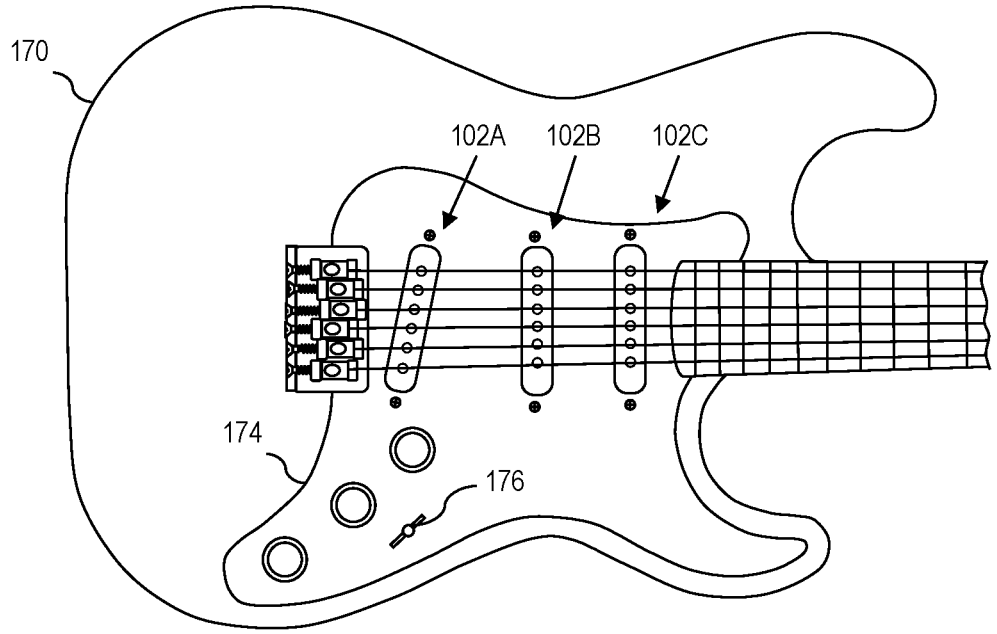
FIG. 7 is a top view of the instrument body of FIG. 5, showing the pickups installed in the instrument body, according to aspects of the present disclosure.

Referring to FIG. 7 with reference back to FIG. 6, a view illustrates the pickups 102A, 102B, 102C installed in the instrument body 170. Notably, when installed, each hum-cancelling coil 132A, 132B, 132C is vertically stacked underneath a corresponding pickup 102A, 102B, 102C, thus rendering the appearance of a conventional pickup configuration because the hum-cancelling coil 132A, 132B, 132C is hidden in the pickup cavity.

FIG. 7 also shows that the illustrated instrument includes a pickup selector switch 176 that allows the performer to select various pickup combinations. For instance, a wiring of the switch 176 in the example three pickup 102 configuration can provide five example combinations, discussed below for purpose of illustration and not by way of limitation.

In switch position 1, the bridge pickup 102A is electrically connected to the instrument output, whereas the middle pickup 102B and the neck pickup 102C are isolated from the instrument output.

In switch position 2, the bridge pickup 102A and the middle pickup 102B are electrically connected to the instrument output, whereas the neck pickup 102C is isolated from the instrument output.

In switch position 3, the middle pickup 102B is electrically connected to the instrument output, whereas the bridge pickup 102A and the neck pickup 102C are isolated from the instrument output.

In switch position 4, the middle pickup 102B and the neck pickup 102C are electrically connected to the instrument output, whereas the bridge pickup 102A is isolated from the instrument output.

In switch position 5, the neck pickup 102C is electrically connected to the instrument output, whereas the bridge pickup 102A and the middle pickup 102B are isolated from the instrument output.

Hum-Cancelling Wiring

Referring to FIG. 8, in an illustrative example, such as for the instrument of FIG. 6 and FIG. 7 (three pickup configuration), a truth table 200 illustrates the wiring of the various pickups 102 and hum-cancelling coils 132 for various switch positions.

In an example configuration of a three-pickup system, such as illustrated herein, there are three hum-cancelling coils 132A, 132B, 132C (FIG. 6). In an example embodiment, each hum-cancelling coil 132A, 132B, 132C is calibrated to provide approximately ⅓ of the total hum-cancelling effect. Moreover, each of the hum-cancelling coils 132A, 132B, 132C is wired in series to create a single, hum-cancelling circuit. Moreover, each hum-cancelling coil 132A, 132B, 132C should have the same wind direction.

Figure 9:
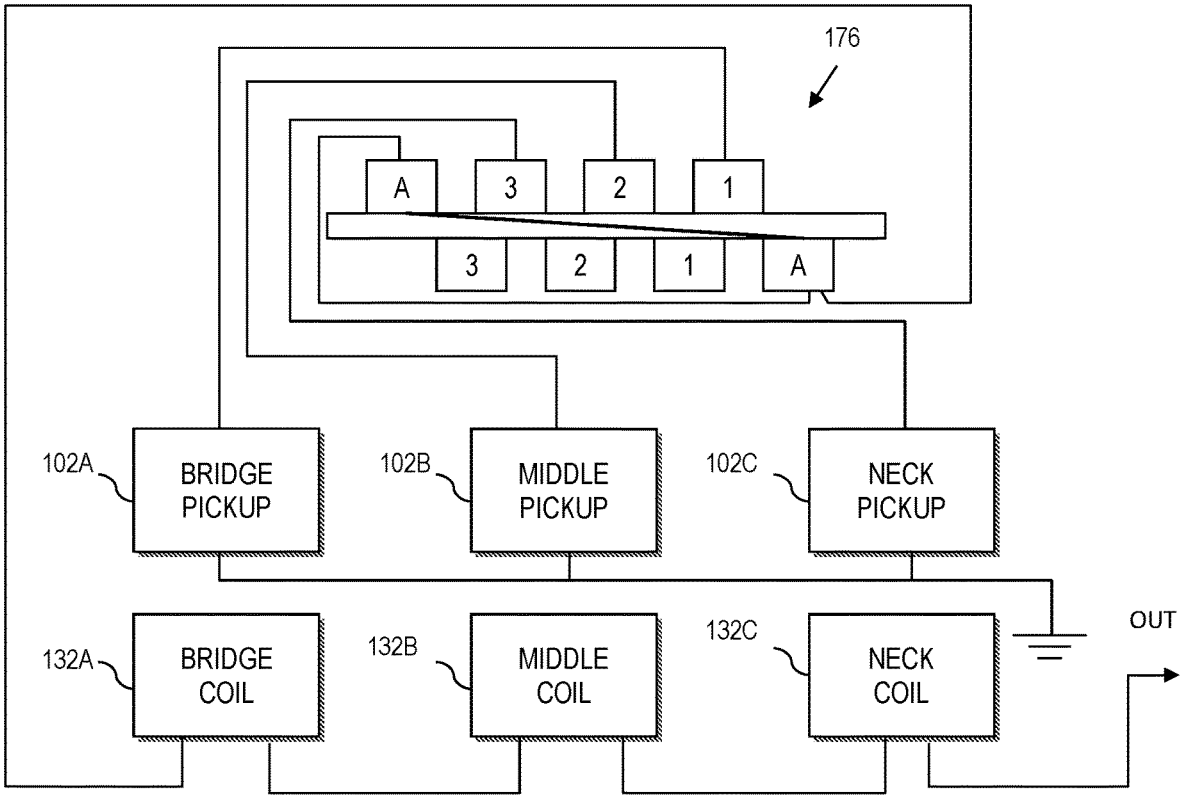
FIG. 9 is a circuit diagram illustrating a three pickup switching configuration with hum cancelling effect in all switch positions, where the hum cancelling coils are wired in series, and the series combination is in series with the selected pickup/pickup combination.
Figure 10:
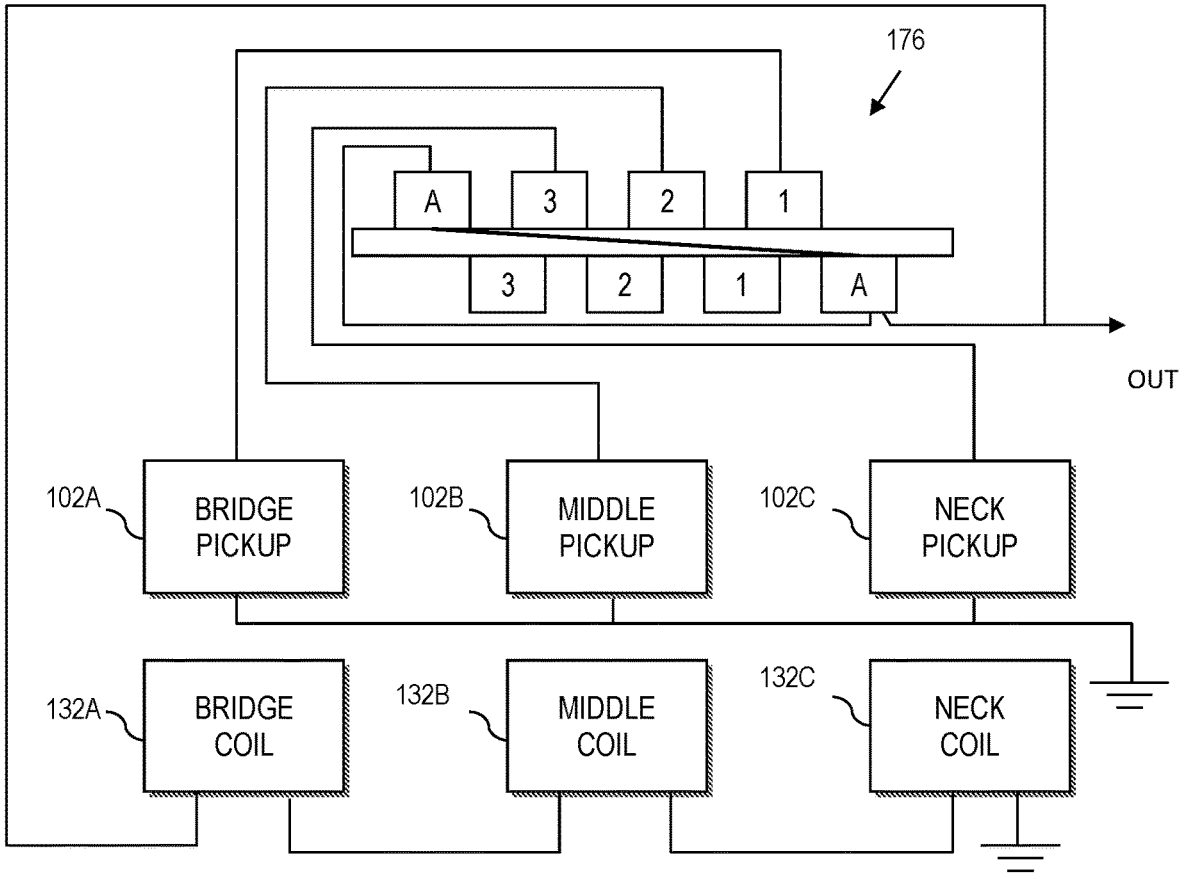
FIG. 10 is a circuit diagram illustrating a three pickup switching configuration with hum cancelling effect in all switch positions, where the hum cancelling coils are wired in series, and the series combination is in parallel with the selected pickup/pickup combination.

With reference to FIG. 8, FIG. 9 and FIG. 10, when the instrument is in switch position 1, the bridge pickup 102A is wired to the hum-cancelling circuit of the three hum-cancelling coils 132A, 132B, 132C. By way of example, FIG. 9 shows an example configuration where the bridge pickup 102A is wired in series with the hum-cancelling circuit, whereas FIG. 10 shows an example configuration where the bridge pickup 102A is wired in parallel with the hum-cancelling circuit.

When the instrument is in switch position 2, the bridge pickup 102A and the middle pickup 102B are wired in parallel. That parallel circuit is then wired to the hum-cancelling circuit of the three hum-cancelling coils 132A, 132B, 132C. FIG. 9 shows an example configuration where the parallel circuit (bridge pickup 102A and the middle pickup 102B) is wired in series with the hum-cancelling circuit, whereas FIG. 10 shows an example configuration where the parallel circuit (bridge pickup 102A and the middle pickup 102B) is wired in parallel with the hum-cancelling circuit.

When the instrument is in switch position 3, the middle pickup 102B is wired in series with the hum-cancelling circuit of the three hum-cancelling coils 132A, 132B, 132C. FIG. 9 shows an example configuration where the middle pickup 102B is wired in series with the hum-cancelling circuit, whereas FIG. 10 shows an example configuration where the middle pickup 102B is wired in parallel with the hum-cancelling circuit.

When the instrument is in switch position 4, the middle pickup 102B and the neck pickup 102C are wired in parallel. That parallel circuit is then wired in series with the hum-cancelling circuit of the three hum-cancelling coils 132A, 132B, 132C. FIG. 9 shows an example configuration where the parallel circuit (middle pickup 102B and the neck pickup 102C) is wired in series with the hum-cancelling circuit, whereas FIG. 10 shows an example configuration where the parallel circuit (middle pickup 102B and the neck pickup 102C) is wired in parallel with the hum-cancelling circuit.

When the instrument is in switch position 5, the neck pickup 102C is wired in series with the hum-cancelling circuit of the three hum-cancelling coils 132A, 132B, 132C. FIG. 9 shows an example configuration where the neck pickup 102C is wired in series with the hum-cancelling circuit, whereas FIG. 10 shows an example configuration where the neck pickup 102C is wired in parallel with the hum-cancelling circuit.

The above is meant by way of example only. For instance, when multiple pickups 102 are selected, i.e., electrically connected to the output jack of an associated instrument via the pickup selector switch, the pickups 102 are normally wired together in parallel. However, depending upon the desired configuration, the pickups can be wired in series, parallel, in phase, out of phase, reverse wound, reverse polarity, combinations thereof, etc. In this regard, because the hum-cancelling coils 132 are independent of the pickups 102, any combination of one or more pickups can be combined, in series, or parallel. Likewise, in some embodiments, the hum-cancelling coils 132 are configured to a switch so that either the entirety of the series connection of hum-cancelling coils 132 is used, or some subset thereof. Moreover, switching can be used to take the hum-cancelling effect into, or out of the output of the instrument. For instance, if two pickups are wired together to carry out a hum-bucking effect, it may be desirable to switch out of the output of the instrument, one or more of the hum-cancelling coils.

In some embodiments, the pickup combinations are constrained such that each pickup is wound in the same direction. Here, no combination of pickups 102 will exhibit hum-cancelling on their own. However, the hum-cancelling series circuit of hum-cancelling coils 132 wound in a direction opposite of the pickups 102 can reduce interference. Moreover, more elaborate switching can also add or remove one or more of the hum-cancelling coils 132 from the hum-cancelling circuit if desired for some reason.

Analogous circuits can be implemented for any pickup combination. For instance, in a two-pickup instrument, there may be two pickups 102A, 102B, and two hum-cancelling coils 132A, 132B, and a pickup selector switch that provides three or more combinations of the two pickups. Moreover, the circuit diagram and truth table herein is merely illustrative. In practice, any wiring can be utilized, depending upon when and where hum-cancelling is desired.

With reference to FIG. 9 and FIG. 10, the example wiring diagrams are similar in that the hum cancelling coils 132 are electrically wired in series. However, in FIG. 9, the series of hum-cancelling coils 132 is wired in series with the selected pickup(s) 102. On the other hand, in FIG. 10, the series of hum-cancelling coils 132 is wired in parallel with the selected pickup(s) 102. Each configuration will provide a hum-cancelling effect. However, the tonal impact will be different.

Miscellaneous

The above-constructions work for one or more pickups, using two or more hum-cancelling coils 132. For sake of clarity, there is illustrated one hum-cancelling coil 132 for each pickup 102. In other embodiments, there can be more pickups 102 than hum-cancelling coils 132. In yet additional embodiments, there can be more hum-cancelling coils 132 than pickups 102. Regardless, the hum-cancelling effect is distributed across two or more hum-cancelling coils 132 spaced apart from each other when installed in a stringed musical instrument.

Wind/Polarity

In some embodiments, the hum-cancelling coils 132 each share a common wind direction. That is, each coil of wire in each hum-cancelling coil 132 is wound in the same direction. Also, the pickups 102 can share a common wind direction. That is, each coil of wire in each pickup 102 is wound in the same direction. Here, the wind direction of the hum-cancelling coils is opposite of the wind direction of the pickups. In some embodiments, the magnets in the pickups all share a same magnetic orientation.

In the case of a three-pickup configuration, it is possible to encounter a middle pickup that is wound with reverse wiring relative a corresponding bridge and neck pickup. Typically, the middle pickup also has a reverse magnet polarity relative a corresponding bridge and neck pickup. This provides noise cancelling (but only when the middle pickup is combined with either the bridge pickup or the neck pickup—e.g., positions 2 and 4 discussed above). Here, the wiring diagram can be modified to lift the circuit of the hum-cancelling coils when in switch positions 2, 3, 4, or a combination thereof.

Calibration

In a non-limiting but exemplary embodiment, calibration is accomplished by winding a desired number of hum-cancelling coils 132 to achieve an additive impedance as close as possible to designed for target, e.g., the nominal impedance of a single standard pickup. This will typically allow maximum hum rejection. In other embodiments, the total impedance of the series combination of the hum-cancelling coils is selected to be some percentage less than the nominal impedance of a typical pickup. In other embodiments, the total impedance of the series combination of the hum-cancelling coils is selected to be some percentage greater than the nominal impedance of a typical pickup. In an example embodiment, each hum-cancelling coil 132 will have an inductance that is a fraction of the overall hum-cancelling circuit inductance.

By way of a few illustrative examples, in a system with two-pickups 102 and two hum-cancelling coils 132, each hum-cancelling coil 132 can be wound to have an impedance of approximately ½ the impedance of a single pickup 102. In a three-pickup configuration using three hum-cancelling coils 132, each hum-cancelling coil 132 can be wound to have an impedance of approximately ⅓ the impedance of a single pickup 102.

In other examples, the fractional contribution of each hum-cancelling coil 132 need not be the same. For instance, in a system with two hum-cancelling coils 132, the first hum-cancelling coil 132 can contribute >50% of the total impedance of a hum-cancelling circuit formed by a series connection of the first and second hum-cancelling coils, whereas the second hum cancelling coil 132 can contribute <50% of the impedance of the hum-cancelling circuit. This concept can be expanded as desired, e.g., to achieve a balance between hum-cancelling and tone. For instance, each hum-cancelling coil 132 can be would to a slightly different impedance to account for the difference in impedance between corresponding pickups, etc. Also, the total impedance of the series circuit of the hum-cancelling coils can be generally the same as, greater than, or less than, the impedance of a corresponding pickup, e.g., to balance noise cancelling and influence the tone of the pickup.

In practice, instruments such as electric guitars can have pickup combinations where two or more pickups 102 have different impedances. Here, the hum-cancelling coils 132 can be designed to strike a balance between tone and noise cancelling by selecting a total overall impedance when wired in series, taking into account, the impedance of each pickup 102.

A unique aspect of the present disclosure is the distribution of the hum cancelling effect over multiple coils (2, 3, or more, etc.,) connected in series, arranged in a manner beneath existing pickups that provide effective rejection of 60 cycle hum and other electrical noise. This approach maximizes the retention of true single coil tonal qualities which is widely regarded as superior by many musicians. Notably, the distribution of a series circuit of hum cancelling coils does not require additional external tuning circuits to optimize the effect.

For instance, in an example embodiment, a first hum-cancelling coil is positioned proximate to, but is wired independent of the wiring of the first pickup to a corresponding pickup selector switch or other guitar electronics, and a second hum-cancelling coil is positioned proximate to, but is wired independent of the wiring of the second pickup to the corresponding pickup selector switch or other guitar electronics. This allows the instrument, e.g., via a pickup selector to switch pickups in or out of the circuit independent of the hum-cancelling effect of the series hum-cancelling coils.

Analogously, e.g., for a three-pickup guitar, a third hum-cancelling coil is positioned proximate to but is wired independent of the wiring of the third pickup to a corresponding pickup selector switch or other guitar electronics. Thus, even though a hum-cancelling coil and a pickup share the same route cavity in an instrument, the hum-cancelling coil is not hard wired to the corresponding pickup leads. Rather, leads from the hum-cancelling coil form a series circuit with one or more other hum-cancelling coils. That overall series circuit is then wired to guitar electronics, e.g., a pickup, selector switch, output jack, volume or tone circuitry, active equalization circuitry, etc. Likewise, there is not a one-to-one direct wiring of pickup leads to a corresponding hum-cancelling coil.

The hum-cancelling pickup system herein provides superior results including hum (and other common mode) hum rejection while retaining overall tonal quality. Instead of needing to completely cancel the hum of one pickup with a single hum cancelling coil, the distributed system herein uses multiple coils (two, three, etc.), which allows the use of a relatively larger diameter wire for each hum-cancelling coil. This has less impact on the true single coil character of the single pickup compared to other conventional hum-cancelling approaches.

Moreover, in many cases, the hum-cancelling coils can be added to conventional instruments with single coil pickups. Because the wiring need only wire the hum-cancelling coils 132 in series, and wire the circuit of the hum-cancelling coils in series or parallel with one or more pickups, and because the hum-cancelling coils stack neatly underneath the pickups, regular pickups that are selected by a musician can be used, with minimal to no impact on tone (other than the reduction or elimination of hum and other noise/interference). Moreover, by using fewer wraps of wire, and multiple hum-cancelling coils, the hum-cancelling coils can be retrofitted into existing guitars, with the possibility of no modification to the instrument body, and no change to the visual aesthetic of the instrument.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. Aspects of the disclosure were chosen and described in order to best explain the principles of the disclosure and the practical application, and to enable others of ordinary skill in the art to understand the disclosure for various embodiments with various modifications as are suited to the particular use contemplated.

What is claimed is:

1. A hum-cancelling system comprising:
- a first hum-cancelling coil, comprising:
  - a top plate;
  - a bottom plate; and
  - a coil of wire wrapped between the top plate and the bottom plate; and
- a second hum-cancelling coil, comprising:
  - a top plate;
  - a bottom plate; and
  - a coil of wire wrapped between the top plate and the bottom plate;

wherein:
- the coil of wire of the first hum-cancelling coil is operationally configured to wire in series with the coil of wire of the second hum-cancelling coil;
- the combined series impedance of the first hum-cancelling coil and the second hum-cancelling coil the coil is configured to exhibit a total impendence up to a nominal impedance of one single-coil pickup of a stringed musical instrument to which the hum-cancelling system is installed; and
- when installed in a stringed musical instrument:
  - the coil of wire of the first hum-cancelling coil is wound in the same direction as the coil of wire of the second hum-cancelling coil;
  - the first hum-cancelling coil is spaced from the second hum-cancelling coil;
  - the first hum-cancelling coil is positioned proximate to a first pickup; and
  - the second hum-cancelling coil is positioned proximate to a second pickup.

2. The hum-cancelling system of claim 1 further comprising:
- a first mu-metal shield positioned over the first hum-cancelling coil; and
- a second mu-metal shield positioned over the second hum-cancelling coil.

3. The hum-cancelling system of claim 1 further comprising:
- a third hum-cancelling coil, comprising:
  - a top plate;
  - a bottom plate; and
  - a coil of wire wrapped between the top plate and the bottom plate;

wherein:
- the coil of wire of the third hum-cancelling coil is wound in the same direction as the coil of wire of the first hum-cancelling coil and the second hum-cancelling coil; and
- the coil of wire of the third hum-cancelling coil is operationally configured to wire in series with the coil of wire of the second hum-cancelling coil.

4. The hum-cancelling system of claim 1, wherein:
- the first hum-cancelling coil is free of a magnetic pole;
- the second hum-cancelling coil is free of a magnetic pole;
- when installed in a stringed musical instrument:
  - the first hum-cancelling coil is positioned proximate to and is wired independent of the wiring of the first pickup to a corresponding pickup selector switch or other guitar electronics; and
  - the second hum-cancelling coil is positioned proximate to and is wired independent of the wiring of the second pickup to the corresponding pickup selector switch or other guitar electronics.

5. The hum-cancelling system of claim 1, wherein:
the coil of wire of the first hum-cancelling coil is configured to have the same nominal impedance as the coil of wire of the second hum-cancelling coil.

6. The hum-cancelling system of claim 1, wherein:
the coil of wire of the first hum-cancelling coil is configured to have a different nominal impedance as the coil of wire of the second hum-cancelling coil.

7. A hum-cancelling system comprising:
a first hum-cancelling coil, comprising:
a top plate;
a bottom plate; and
a coil of wire wrapped between the top plate and the bottom plate;
a second hum-cancelling coil, comprising:
a top plate;
a bottom plate; and
a coil of wire wrapped between the top plate and the bottom plate;
a first pickup comprising:
a top flatwork;
a bottom flatwork;
a coil assembly comprising a coil of wire wrapped around at least one magnetic pole;
a second pickup comprising:
a top flatwork;
a bottom flatwork;
a coil assembly comprising a coil of wire wrapped around at least one magnetic pole;
wherein, when installed in a stringed musical instrument:
the coil of wire of the first hum-cancelling coil is operationally configured to wire in series with the coil of wire of the second hum-cancelling coil to define a hum-cancelling circuit;
the coil of wire of the first hum-cancelling coil is wound in the same direction as the coil of wire of the second hum-cancelling coil;
a wind direction of the first pickup is opposite a wind direction of the first hum-cancelling coil and the second hum-cancelling coil; and
the hum-cancelling circuit is switchably connected to at least one of the first pickup and the second pickup.

8. The hum-cancelling system of claim 7, wherein:
when installed in a stringed musical instrument:
the first pickup is mounted on top of the first hum-cancelling coil; and
the second pickup is mounted on top of the second hum-cancelling coil.

9. The hum-cancelling system of claim 7, wherein:
when installed in a stringed musical instrument, the hum-cancelling circuit is switchably connected in series to at least one of the first pickup and the second pickup.

10. The hum-cancelling system of claim 7 further comprising:
a first magnetic shield positioned between the first pickup and the first hum-cancelling coil; and
a second magnetic shield positioned between the second pickup and the second hum-cancelling coil.

11. The hum-cancelling system of claim 7 further comprising:
a third hum-cancelling coil, comprising:
a top plate;
a bottom plate; and
a coil of wire wrapped between the top plate and the bottom plate;
a third pickup comprising:
a top flatwork;
a bottom flatwork;
a coil assembly comprising a coil of wire wrapped around at least one magnetic pole;
wherein, when installed in a stringed musical instrument:
the coil of wire of the third hum-cancelling coil is operationally configured to wire in series with the coil of wire of the first hum-cancelling coil and the coil of wire of the second hum-cancelling coil to define a hum-cancelling circuit; and
the hum-cancelling circuit is switchably connected to at least one of the first pickup, the second pickup, and the third pickup.

12. The hum-cancelling system of claim 11, wherein, when installed in a stringed musical instrument, the hum-cancelling circuit is switchably connected in series to at least one of the first pickup, the second pickup, and the third pickup.

13. The hum-cancelling system of claim 11, wherein, when installed in a stringed musical instrument, the hum-cancelling circuit is switchably connected in parallel to at least one of the first pickup, the second pickup, and the third pickup.

14. The hum-cancelling system of claim 7, wherein:
the coil of wire of the first hum-cancelling coil is configured to have the same nominal impedance as the coil of wire of the second hum-cancelling coil.

15. The hum-cancelling system of claim 7, wherein:
the combined series impedance of the first hum-cancelling coil and the second hum-cancelling coil the coil is configured to exhibit a total impendence up to a nominal impedance of one single-coil pickup of a stringed musical instrument to which the hum-cancelling system is installed.

16. A stringed musical instrument, comprising:
an instrument body;
a first hum-cancelling coil mounted to the instrument body;
a second hum-cancelling coil mounted to the instrument body spaced apart from the first hum-cancelling coil so as to not touch or overlap;
a first pickup mounted to the instrument body over the first hum-cancelling coil;
a second pickup mounted to the instrument body over the second hum-cancelling coil;
a pickup selector switch that allows selecting at least one of the first pickup and the second pickup for output; and
a circuit that electrically wires the first hum-cancelling coil in series with the second hum-cancelling coil, and wherein the circuit is electrically coupled to at least one of the first pickup and the second pickup regardless of a position of the pickup selector switch.

17. The stringed musical instrument of claim 16, wherein:
the circuit is electrically coupled to at least one of the first pickup and the second pickup regardless of a position of the selector switch by electrically wiring the circuit in series to at least one of the first pickup and the second pickup.

* * * * *